US005640815A

United States Patent [19]

Chinzi

[11] Patent Number: 5,640,815

[45] Date of Patent: Jun. 24, 1997

[54] MULTIPLE GLAZING UNIT

[75] Inventor: Calogero Chinzi, La Louvière, Belgium

[73] Assignee: Glaverbel, Brussels, Belgium

[21] Appl. No.: 492,607

[22] Filed: Jun. 20, 1995

[30] Foreign Application Priority Data

Jun. 30, 1994 [GB] United Kingdom ..... 9413180

[51] Int. Cl.[6] ..... E06B 3/66

[52] U.S. Cl. ..... 52/172; 52/786.13; 428/34

[58] Field of Search ..... 52/786.1, 786.11, 52/786.13, 171.3, 172; 156/109, 107; 428/34

[56] References Cited

U.S. PATENT DOCUMENTS

| | | | |
|---|---|---|---|
| 3,280,523 | 10/1966 | Stroud et al. | 52/172 |
| 3,630,814 | 12/1971 | Arnold | 52/786.13 |
| 4,205,104 | 5/1980 | Chenel | 428/34 |
| 4,499,703 | 2/1985 | Rundo | 52/172 |
| 4,622,249 | 11/1986 | Bowser | 428/34 |
| 4,830,913 | 5/1989 | Ortmans et al. | 428/34 |
| 5,088,258 | 2/1992 | Schield et al. . | |

FOREIGN PATENT DOCUMENTS

| | | | |
|---|---|---|---|
| 0 113 209 | 7/1984 | European Pat. Off. . | |
| 0 223 511 | 5/1987 | European Pat. Off. . | |
| 0534175 | 3/1993 | European Pat. Off. . | |
| 0 586 121 | 3/1994 | European Pat. Off. . | |
| 1 950 528 | 6/1971 | Germany . | |
| 2526438 | 12/1976 | Germany | 52/786.13 |
| 628314 | 11/1961 | Italy | 52/786.13 |
| 1117028 | 6/1968 | United Kingdom | 52/172 |
| 1 600 898 | 10/1981 | United Kingdom . | |
| 2 077 834 | 12/1981 | United Kingdom . | |
| WO86/01248 | 2/1986 | WIPO . | |
| WO94/17260 | 8/1994 | WIPO . | |

*Primary Examiner*—Michael Safavi
*Attorney, Agent, or Firm*—Spencer & Frank

[57] ABSTRACT

A multiple glazing unit comprising two vitreous material sheets positioned in a face-to-face spaced apart relationship, and having a gas space there-between delimited by a peripherally extending spacer. Layers of sealant are positioned between the spacer and each of the sheets. A cordon or cordons of resin are positioned in contact the layers of sealant and extending between the spacer and each of the sheets. At least part of each face of the spacer in contact with the sealant extends obliquely with respect to the inner surface of the adjacent sheet. The layers of sealant extend progressively from a region of minimum thickness to a region of maximum thickness. The resin is in contact with the sealant substantially in the region of maximum thickness. The spacer has a cross-section which is open to the gas space and/or the oblique faces of the spacer extend at an angle of at least 9.1°. The penetration of water into the interior of the unit is reduced by the above construction, significantly improving the life expectancy the above glazing unit.

14 Claims, 3 Drawing Sheets

MULTIPLE GLAZING UNIT

CROSS-REFERENCE TO RELATED APPLICATION

This application claims the priority of United Kingdom Patent Application N° 94 13 180.2 filed Jun. 30, 1994 and titled "MULTIPLE GLAZING UNIT", the subject matter of which is incorporated herein by reference.

BACKGROUND OF THE INVENTION

1. Field of the invention

This invention relates to multiple glazing units, in particular to multiple glazing units of the type comprising two vitreous material sheets positioned in a face-to-face spaced apart relationship and having a gas space there-between delimited by a peripherally extending spacer.

Multiple glazing units, for example double glazing units, are very useful for increasing thermal and sound insulation and are beneficial with regard to the sound in the interior of buildings and therefore for increasing the comfort of the occupants of the building compared to the poor insulation provided by ordinary single glazing units.

2. Description of the Related Art

Double glazing units are constituted by two sheets of vitreous material such as, glass, which are fixed and maintained in a spaced relationship with respect to one another, usually at their edges, by the intervention of a spacer. The spacer is usually a metallic profile which is adhered to the sheets, along the length of the four edges thereof. A hermetically sealed hollow space is formed between the sheets, delimited by the spacer. This space is filled with a dry gas such as dry air. A desiccant is generally associated with the spacer, in communication with the sealed hollow space in order to help maintain the gas in a dry state. It is essential that the gas confined within the space should be maintained in a dry state in order to avoid any condensation of water at the interior of the double glazing during changes in temperature. If there is condensation of water vapour on the internal walls of the sheets, the transparency of the glazing will be reduced and the visibility through the glazing will be affected.

A water tight joint is achieved with the aid of two different materials. The first material, which is highly water impermeable, but relatively flexible, is referred to generally herein as a "sealant", and may for example be a polyisobutylene. The second material which is highly adhesive and relatively rigid, is referred to generally herein as a "resin", and may for example be a polysulphide, a polyurethane elastomer or a silicone material.

A layer of sealant is positioned between the spacer and each of the sheets. A cordon of resin is positioned in contact with the sealant and extends between the sheets beyond the spacer. Alternatively, cordons of resin are positioned between the spacer and each of the sheets. Under normal conditions (at rest), while the internal pressure, that is the pressure within the gas space, is equal to the external pressure, water vapour can only enter the closed gas space of the double glazing unit, if there is a difference in partial pressure of water between the interior of the double glazing and the exterior, via the sealant between each sheet and the spacer. The sealant constitutes a barrier to the passage of humidity. Since it is a flexible material relatively impermeable to water, the humidity can therefore penetrate only with great difficulty and the small amount of water which penetrates with time is absorbed by the desiccant.

During the heating of the glazing, the internal atmosphere of the double glazing expands and the internal pressure increases. The difference between the internal and external pressures causes a force to be exerted on the sheets which tends to separate them from one another and which thereby subjects the joint to a traction stress. The resin stretches slightly and the sealant undergoes a similar expansion. If the expansion of the sealant is greater than the limit of de-cohesion thereof, the sealant ceases to be a good impermeable barrier and water can cross the joint more easily. The resin does not constitute an impermeable barrier to water; its role is to firmly maintain the two sheets in face-to-face relationship, with interposition of the spacer.

In European patent application EP-A-0534175 (Franz Xaver Bayer Isolierglasfabrik) there is described a multiple glazing unit comprising two glass sheets positioned in a face-to-face spaced apart relationship and having a gas space there-between delimited by a peripherally extending spacer. The spacer contacts the sheets and then extends slightly obliquely with respect to the inner surface of the adjacent sheet, so as to accommodate layers of butyl sealant which are positioned between the spacer and each of the sheets. Such an arrangement is intended to avoid escape of the sealant from its location to the gas space when relative movements of the sheets with regard to the spacer occur. A cordon of adhesive material is positioned in contact with the layers of sealant and extends between the spacer and each of the sheets. In the described glazing unit, the butyl sealant is disposed within a very narrow space so as to form a very narrow diffusion width to limit the passage for the ingress of humidity. However, this construction means that small movements of the glass sheets relative to each other and to the spacer result in a high elongation percentage of the sealant material, which can easily exceed its de-cohesion limit, resulting in a failure of the seal and the ingress of humidity.

Furthermore, in the described glazing unit, the above disadvantage is increased by the fact that a substantial proportion of the adhesive material extends beyond the spacer. As it is this material which serves to hold the glass sheets together against the spacer, movements of the glass sheets relative to the spacer depend on its total elongation which will be relatively high because of its large size. The total elongation of the butyl sealant in absolute terms must be equally as high and therefore the percentage elongation of the sealant can more easily exceed its de-cohesion limit, resulting in a failure of the seal and the ingress of humidity.

SUMMARY OF THE INVENTION

The penetration of water to the interior of the double glazing significantly reduces the life expectancy and it is therefore an object of the present invention to overcome this disadvantage of multiple glazing units of the type discussed above.

We have surprising discovered that this objective can be overcome and that other benefits may result from providing the spacer which is shaped in a particular manner.

Thus, according to a first aspect of the invention, there is provided a multiple glazing unit comprising two vitreous material sheets positioned in a face-to-face spaced apart relationship, and having a gas space there-between delimited by a peripherally extending spacer, layers of sealant being positioned between the spacer and each of the sheets and a cordon or cordons of resin being positioned in contact with the layers of sealant and extending at least between the spacer and each of the sheets. At least part of each face of the spacer in contact with the sealant extends obliquely with respect to the inner surface of the adjacent sheet, such that the layer of sealant in contact therewith extends progressively from a region of minimum thickness to a region of maximum thickness, the resin being in contact with the sealant substantially in the region of maximum thickness and the spacer has a cross-section which is open to the gas space.

We have found that this particular form of spacer is favourable to improving the life expectancy of the glazing and also improves the thermal isolation because, for a given level of water vapour penetration, the thermal bridge generated by the spacer at the edges of the glazing unit is reduced. Its open cross-section enables the spacer to be formed with flexible arm portions, which modify the manner in which the sealant deforms in the event of relative movement between the sheets and the spacer. The above in turn facilitates the conservation of the sealing function and therefore improves the life expectancy of the panel. Furthermore, an open structure for the section reduces the thermal bridge formed by the presence of the spacer at the edges of the panel, resulting in an improvement in thermal isolation.

By arranging for the sealant to have a region of minimum thickness, the distance between the spacer and the sheets will be a minimum in this region, and may even be lower than that conventionally used and may be less than 1.0 mm, preferably not greater than 0.5 mm, most preferably not greater than 0.2 mm. We have found that to obtain a high level of sealing, it is important that the spacer should be as close as possible to the vitreous sheets in the region of minimum thickness of the sealant in order to reduce any passage for the ingress of humidity into the gas space.

The smaller the distance between the sheets and the spacer in the region of minimum thickness, the narrower is the access pathway that the humidity must pass through in order to penetrate into the gas space of the glazing unit. This characteristic consequently enables the sealing of the internal space of the unit. Preferably this distance should be as small as possible and may at the limit be zero. However, it is best to avoid direct contact between the spacer and the sheets of glass, which, if the spacer is metallic would among other things provide an unfavourable thermal isolation.

We have found that it is also important that the sealant has a thickness which is relatively high so that the percentage elongation is reduced compared to the total elongation and that this thickness should exist over a depth which is sufficient to establish an efficient barrier to water vapour.

By arranging for the sealant to have a region of maximum thickness, even thicker than is conventionally used, its relative elongation as it stretches under the stress of thermal changes is less than would be otherwise with a lower thickness, reducing the risk that its limit of de-cohesion would be reached. The risk of ingress of humidity through the joint is therefore reduced. The overall result is therefore a multiple glazing unit having an improved life expectancy. Furthermore, for a given life expectancy the quantity of sealant used in the joint may be reduced, resulting in cost savings. A maximum sealant thickness of from 1.0 to 2.0 mm has been found to be suitable.

With a minimum sealant thickness of less than 0.2 mm and a maximum sealant thickness of at least 1.0 mm, given a typical sealant depth of 5 mm, the preferred angle for the oblique part of each face of the open cross-section spacer with respect to its adjacent sheet is at least 9.1° from the region of minimum thickness, and most preferably this angle is at least 10°, advantageously at least 12°, even 18° or more. This oblique angle preferably extends over at least the greater part of the depth of the sealant (e.g. at least 60% thereof).

We have in fact found that the critical limit of 9.1° referred to above provides novel advantages to the multiple glazing units which incorporate not only open cross-section spacers, but also closed cross-section spacers where the resin serves to firmly bond each sheet to the spacer.

Therefore, according to a second aspect of the invention, there is provided a multiple glazing unit comprising two vitreous material sheets positioned in a face-to-face spaced apart relationship, and having a gas space there-between delimited by a peripherally extending spacer, layers of sealant being positioned between the spacer and each of the sheets and a cordon or cordons of resin positioned in contact with the layers of sealant and extending between the spacer and each of the sheets to firmly bond each sheet to the spacer, wherein at least the portion of each face of the spacer in contact with the sealant extends obliquely with respect to the inner surface of the adjacent sheet, such that the layer of sealant in contact therewith extends progressively from a region of minimum thickness with an angle of at least 9.1° to a region of maximum thickness, the resin being in contact with the sealant substantially in the region of maximum thickness.

In this aspect of the invention, the layer of sealant in contact with the obliquely extending spacer face portion preferably extends progressively from the region of minimum thickness with an angle of at least 10°, advantageously at least 12°, even 18° or more to the region of maximum thickness.

The cordon of resin is preferably in contact with the spacer. Thus, the resin is in contact with the sealant part way along the obliquely extending faces of the spacer. The resin preferably extends to a depth of at least 2.0 mm inwardly along the surface of said vitreous material sheets. The depth of the resin beyond the spacer between the sheets, that is the depth of insertion of the spacer in the resin, is preferably not greater than 0.2 mm, most preferably not greater than 0.1 mm. This arrangement provides an advantage in terms of the quantity of resin which is used. We have found that for optimum sealing it is preferable that the minimum thickness of the resin, which occurs where it is in contact with the sealant, should be sufficiently thick in order to support forces such as differential shearing forces between the spacer and the vitreous material sheets without tearing. If the resin were to tear at a given location, it initiates a rupture and further the forces which apply at this location have to be accommodated by that part of the resin which remains intact. It is also preferable that a substantial part of the total amount of resin should be found between the spacer and the vitreous material sheets (having as small a depth as possible between the sheets beyond the spacer) so that the total elongation, under traction, should be low so that the total elongation of the sealant can also be low.

In one embodiment of the invention, part of each face of the spacer in contact with the sealant extends obliquely, while a remaining part of each the face extends substantially parallel to the inner surface of the adjacent sheet, thereby to form an extended region of maximum sealant thickness.

The spacer may be formed of a metal or of a plastics material. The spacer may have a hollow trapezium shaped cross-section, the inner wall of which is provided with a slot to ensure that the interior of the spacer is open to the air space. Alternatively, the cross-section of the spacer has a flared "U" shape. Such a cross-section may comprise two flared arm portions interconnected by a base portion. The flared arm portions may be deformably connected to the base portion to enable some flexibility of the cross-sectional shape of the spacer which serves to take up some of the stresses that result from temperature increases or other causes.

A desiccant may be located within the spacer. The desiccant material located within the spacer may be continuous in the form of a cartridge or a tablet which is fixed or bonded to the base of the spacer or it may be introduced as an additive, at a level of for example 20% or more by weight, into polyisobutylene which is extruded over the base of the spacer and to which it adheres. Alternatively or additionally, the sealant may contain a desiccant, such as at a level of about 20% by weight.

The invention also provides, according to a third aspect, a multiple glazing unit spacer having a flared "U" shape comprising two flared arm portions interconnected by a base portion and an open cross-section, such that when the spacer is incorporated in a multiple glazing unit comprising two vitreous material sheets positioned in face-to-face spaced apart relationship, with the spacer extending peripherally to delimit a gas space between the sheets and the open cross-section of the spacer being open to the gas space, layers of sealant being positioned between the spacer and each of the sheets and a cordon or cordons of resin being positioned in contact with the layers of sealant and extending at least between the spacer and each of the sheets, at least part of each face of the spacer in contact with the sealant extends obliquely with respect to the inner surface of the adjacent sheet, and the layer of sealant in contact therewith extends progressively from a region of minimum thickness to a region of maximum thickness, the resin being in contact with the sealant substantially in the region of maximum thickness.

BRIEF DESCRIPTION OF THE DRAWINGS

The invention will now be further described, by way of example, with reference to the accompanying drawings, in which.

DESCRIPTION OF THE PREFERRED EMBODIMENTS

EXAMPLE 1

Figure 1:
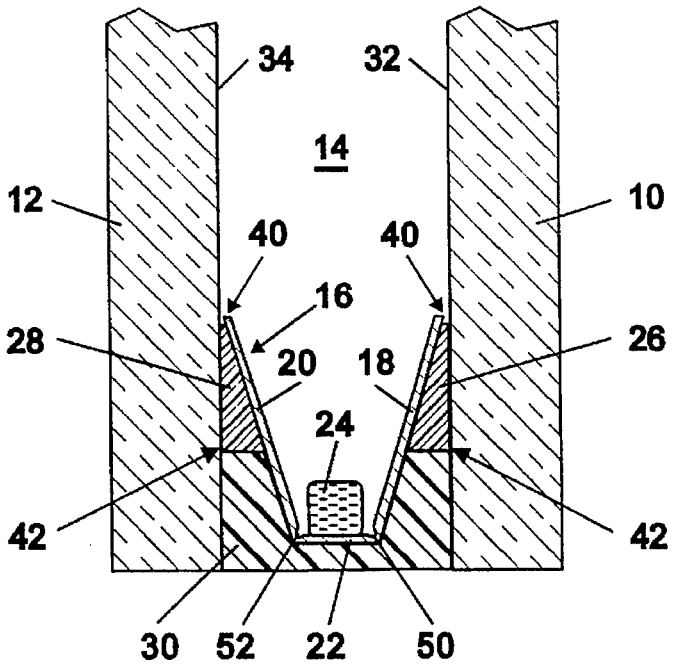
FIG. 1 shows in partial cross-section a double glazing unit according to a first embodiment of the invention.

Referring to FIG. 1, there is shown a double glazing unit comprising two glass sheets 10, 12 positioned in a face-to-face spaced apart relationship, and having a dry air gas space 14 there-between delimited by a peripherally extending spacer 16 formed of galvanised steel of 0.4 mm thickness. The cross-section of the spacer 16 has a flared "U" shape, comprising two flared arm portions 18, 20 interconnected by a base portion 22. The flared arm portions 18, 20 are deformably connected to the base portion 22, the connection points being partly cut away as shown at 50, 52 to achieve this flexibility. The cross-section is open to the gas space 14. A tablet 24 of desiccant material is located within the spacer 16. Layers of polyisobutylene sealant 26, 28 are positioned respectively between the spacer 16 and each of the sheets 10, 12. The polyisobutylene used has a permeability of about 0.11 g water×mm thickness per $m^2$×24 h×kPa water vapour. A cordon of polysulphide or silicone resin 30 is positioned in contact with the sealant 26, 28 between each of the sheets 10, 12 and the spacer 16 and between the sheets 10, 12 beyond the spacer 16. The arm portions 18, 20 of the spacer 16, which are in contact with the sealant 26, 28 each extends obliquely at an angle of 19° with respect to the inner surface 32, 34 of the adjacent sheets 10, 12, such that the layers of sealant 26, 28 in contact therewith extend progressively from a region 40 of minimum thickness of about 0.1 mm to a region 42 of maximum thickness of 1.5 mm. The depth of the sealant is 5 mm and the total depth of the resin is also 5 mm. The resin extends over a depth of from 3.5 to 4 mm between the sheets and the spacer, the remainder (1.0 to 1.5 mm) being found at the back of the spacer between the sheets. The resin 30 is in contact with the sealant 26, 28 in the region 42 of maximum thickness.

In use, the sealant 26, 28 provides a barrier to the penetration of water vapour into the gas space 14 while the resin 30 serves to retain the sheets 10, 12 in their face-to-face relationship. When the temperature rises, the gas pressure within the gas space 14 increases above the external pressure, exerting a stress on the sheets 10, 12 tending to separate them. The resin retains the sheets against their separation, but it stretches slightly under the traction force to which it is submitted. The sealant 26, 28 being a flexible material, elongates to accommodate this movement. The relatively thick sealant region 42 ensures that this elongation does not under normal conditions exceed the de-cohesion limit of the sealant, thus retaining the moisture barrier intact over a depth sufficient to effectively reduce the penetration of water vapour into the space 14 to a negligible value. The relatively thin sealant region 40 enables the distal ends of the spacer arm portions 18, 20 to be positioned close to the sheets 10, 12, thereby reducing the opening to the ingress of moisture.

In a comparison test, a conventional glazing unit was used in which the spacer had sides parallel to the glass sheets with a sealant thickness of 0.5 mm and a depth of 5 mm. The quantity of water which penetrates the unit at equilibrium is measured. This quantity is attributed a sealing index of 1, the sealing index being inversely proportional to the quantity of water which penetrates the unit, so that a higher sealing index is indicative of less water penetration and a higher life expectancy of the unit. The glazing unit of FIG. 1 was then examined and found to have an equilibrium sealing index of 4, which shows an improvement over the conventional construction.

At 60° C., the conventional glazing unit exhibits a sealing index of less than 0.3, while the unit of FIG. 1 was between 1.0 and 1.5. Under the traction stress due to the increase in volume of the internal gas space of the unit, the relative elongation of the butyl sealant is less than 50% over 75% of the total depth of the sealant. As a result, the butyl sealant continues to constitute a relatively efficient barrier to the penetration of water vapour.

By supposing that the glazing is installed on the face of a building, that the external atmospheric temperature is −10° C. and that the internal building temperature is 20° C., we have calculated the temperature of the surface of the internal sheet in the edge zone, close to the spacer. The calculation is based on the finite elements by the method known as "SAMSEF". We have found that, compared with the conventional unit referred to above, the unit of FIG. 1 acts as less of a thermal bridge, i.e. the temperature of the internal sheet in the edge zone close to the spacer is at least 1° C. higher.

The spacer 16 of the embodiment shown in FIG. 1 is folded at a right angle at each corner of the unit, thereby to form a frame which extends continuously along the perimeter of the glass sheets. This folding is effected on a jig in such a way that the arm portions 18, 20 at the level of the zone of maximum sealant thickness 42 are substantially not deformed.

In order to form the unit shown in FIG. 1, seal tubes of polyisobutylene are disposed on the arm portions of the spacer, to an adequate extent, the spacer is disposed along the marginal zone of one of the sheets of glass and the other sheet of glass is disposed there-over to form the double glazing unit. The sheets of glass are then pressed together to squash the butyl sealant to the desired extent between the sheets of glass. In order to prevent the arm portions of the spacer deforming during this process, the bull sealant may be heated to soften it. This may in particular be achieved by heating the spacer, for example by the Joule effect or by induction. Thereafter the resin is injected into the or each peripherally formed space and hardened or allowed to harden.

As a variation of the embodiment shown in FIG. 1, the base portion 22 of the spacer 16 is disposed substantially at the level of the edges of the sheets of glass, e.g. within 1 mm thereof. In this case, there is substantially no resin in contact with the base portion 22 of the spacer, except perhaps for a depth of about 0.1 mm.

EXAMPLE 2

Figure 2:
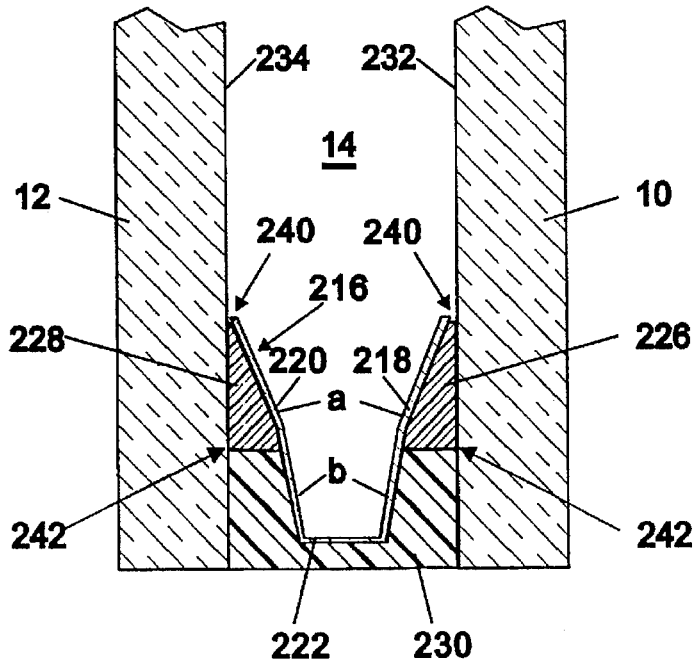
FIG. 2 shows in partial cross-section a double glazing unit according to a second embodiment of the invention.

Referring to FIG. 2, there is shown a double glazing unit comprising two glass sheets 10, 12 positioned in a face-to-face spaced apart relationship and, having a gas space 14 there-between delimited by a peripherally extending spacer 216. The cross-section of the spacer 216 has a flared "U" shape comprising two flared arm portions 218, 220 interconnected by a base portion 222. Layers of sealant 226, 228 are positioned between the spacer 216 and each of the sheets 10, 12. The layers of sealant 226, 228 in contact with the flared arm portions 218, 220 respectively of the spacer 216 each extend progressively from a region 240 of minimum thickness to a region 242 of maximum thickness. Each flared arm portion 218, 220 comprises a distal part a, which extends obliquely at an angle of 22° with respect to the inner surface 232, 234 of the adjacent sheet 10, 12, and a proximal part b, which also extends obliquely with respect to the inner surface 232, 234 of the adjacent sheet 10, 12, but at a lower oblique angle of 14°. A cordon of resin 230 is positioned in contact with the sealant 226, 228 between the sheets 10, 12 beyond the spacer 216, the resin 230 being in contact with the sealant 226, 228 in the region of maximum thickness 242. The total depth of the resin 230 is 5 mm of which from 3.5 to 4 mm lies between the sheets and the spacer, while the remaining 1.0 to 1.5 mm is found at the back of the spacer between the sheets. The spacer 216 has a cross-section which is open to the gas space 14, which may accommodate a desiccant (not shown in FIG. 2). The sealant 226, 228 may also contain a desiccant material at an effective level, for example 20% by weight.

As a variation of the embodiment shown in FIG. 2, the base 222 of the spacer 216 is disposed substantially at the level of the edges of the sheets of glass, e.g. within 1 mm thereof. In this case, there is substantially no resin in contact with the base 222 of the spacer, except perhaps for a depth of about 0.1 mm. The zone of maximum sealant thickness 242 may then be situated at the level of the connection between the distal part a and the proximal part b, that is to say at the point where the inclination changes.

EXAMPLE 3

Figure 3:
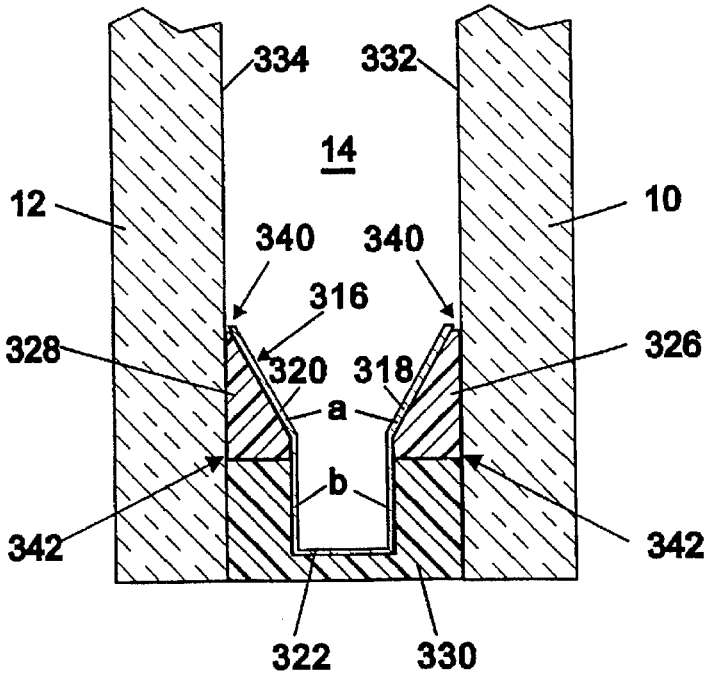
FIG. 3 shows in partial cross-section a double glazing unit according to a third embodiment of the invention.

Referring to FIG. 3, there is shown a double glazing unit comprising two glass sheets 10, 12 positioned in a face-to-face spaced apart relationship and, having a gas space 14 there-between delimited by a peripherally extending spacer 316. The cross-section of the spacer 316 has a flared "U" shape comprising two flared arm portions 318, 320 interconnected by a base portion 322. Layers of sealant 326, 328 are positioned between the spacer 316 and each of the sheets 10, 12. Layers of sealant 326, 328 in contact with the flared arm portions 318, 320 of the spacer 316 extend progressively from a region 340 of minimum thickness to a region 342 of maximum thickness. Each flared arm portion 318, 320 comprises a distal part a which extends obliquely at an angle of 25° with respect to the inner surface 332, 334 of the adjacent sheet 10, 12, and a proximal part b which extends substantially parallel to the inner surface 332, 334 of the adjacent sheet 10, 12, thereby to form an extended region 342 of maximum sealant 326, 328 thickness. A cordon of resin 330 is positioned in contact with the sealant 326, 328 between the sheets 10, 12 beyond the spacer 316, the resin 330 being in contact with the sealant 326, 328 in the region of maximum thickness 342. The total depth of the resin 330 is 5 mm of which from 3.5 to 4 mm lies between the sheets and the spacer, while the remaining 1.0 to 1.5 mm is found at the back of the spacer between the sheets. The spacer 316 has a cross-section which is open to the gas space 14, which may accommodate a desiccant (not shown in FIG. 3).

As a variation of the embodiment shown in FIG. 3, the base 322 of the spacer 316 is disposed substantially at the level of the edges of the sheets of glass, e.g. within 1 mm thereof. In this case, there is substantially no resin in contact with the base 322 of the spacer, except perhaps for a depth of about 0.1 mm. The zone of maximum sealant thickness 342 may then be situated at the level of the connection between the distal part a and the proximal part b, that is to say at the point where the inclination becomes zero.

EXAMPLE 4

Figure 4:
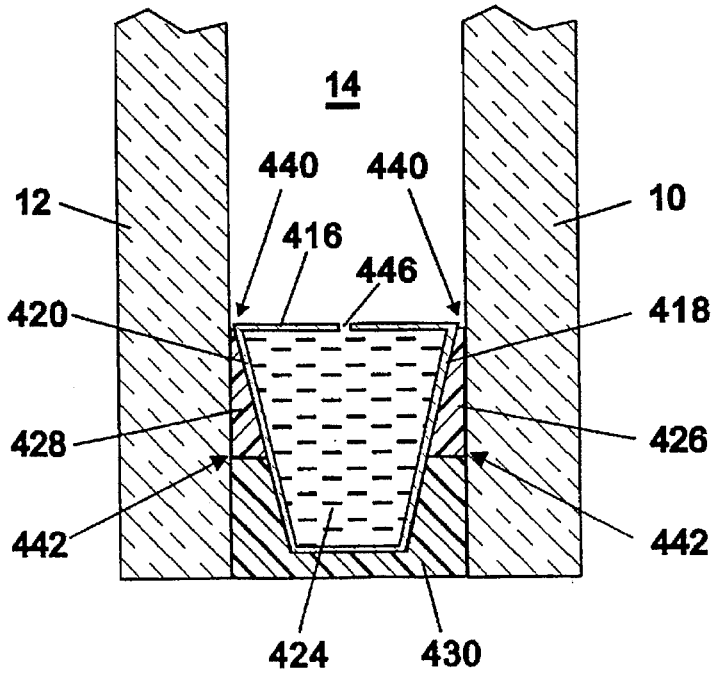
FIG. 4 shows in papal cross-section a double glazing unit according to a fourth embodiment of the invention.

Referring to FIG. 4, there is shown a double glazing unit comprising two glass sheets 10, 12 positioned in a face-to-face spaced apart relationship, and having a gas space 14 there-between delimited by a peripherally extending spacer 416. The cross-section of the spacer 416 has a hollow trapezium shape. The spacer 416 is hollow, the hollow interior of the spacer 416 being open to the gas space 14 by way of the slot 446. Layers of sealant 426, 428 are positioned between the obliquely angled (19°) faces 418, 420 of the spacer 416 and each of the sheets 10, 12. The layer of sealant 426, 428 in contact with the spacer 416 extends progressively from a region 440 of minimum thickness to a region 442 of maximum thickness. A cordon of resin 430 is positioned in contact with the sealant 426, 428 between the sheets 10, 12 beyond the spacer 416, the resin 430 being in contact with the sealant 426, 428 in the region of maximum thickness 442. A desiccant 424 is located in the hollow interior of the spacer 416.

In a variation of the embodiment shown in FIG. 4, the zone 442 may be located at a mid point of the faces 418, 420 of the spacer 416, with substantially no resin being in contact with the bottom wall of the spacer 416.

In a further variation of the embodiment shown in FIG. 4, the hollow interior of the trapezoidal cross-section spacer 416 is generally closed, the slots 446 being replaced by spaced series of holes sufficient to provide a communication between the gas space 14 and desiccant located in the hollow interior of the spacer.

EXAMPLE 5

Figure 5:
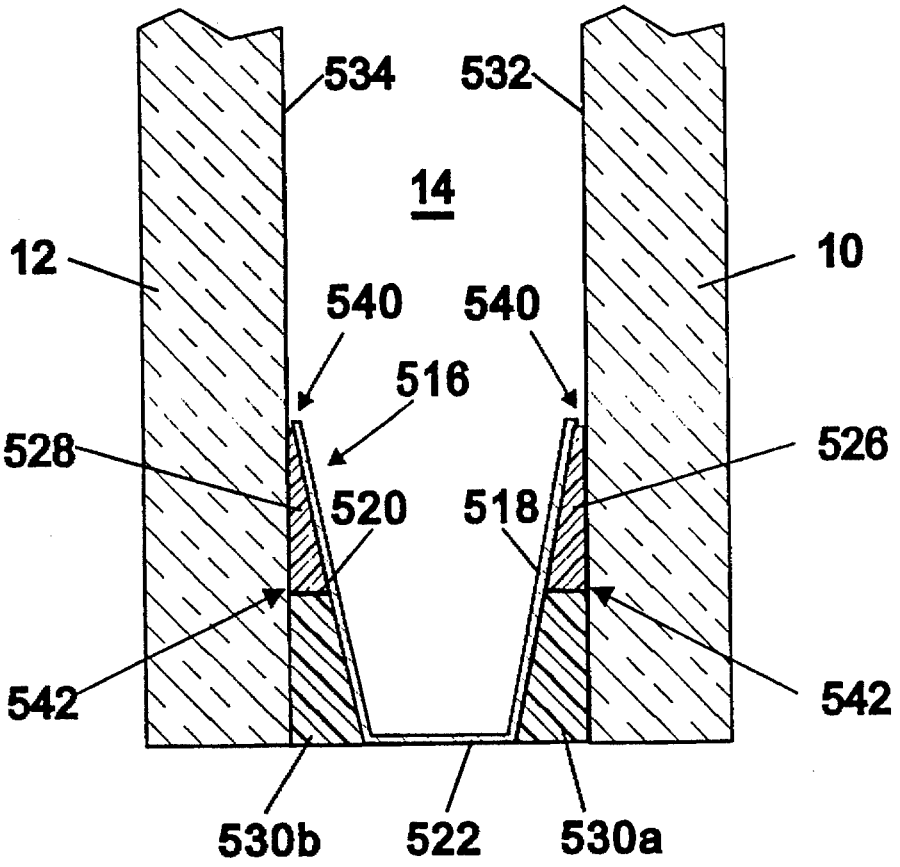
FIG. 5 shows in partial cross-section a double glazing unit according to a fifth embodiment of the invention.

Referring to FIG. 5, there is shown a double glazing unit comprising two glass sheets 10, 12 positioned in a face-to-face spaced apart relationship, and having a dry air gas space 14 there-between delimited by a peripherally extending spacer 516 formed of Al/Zn alloy of 0.3 mm thickness. The cross-section of the spacer 516 has a flared "U" shape, comprising two flared arm portions 518, 520 interconnected by a base portion 522, which is substantially at the same level as the edges of the sheets 10, 12. In this embodiment, the arms 518, 520 are somewhat longer than the arms 18, 20 of the embodiment of FIG. 1. The cross-section is open to the gas space 14. Layers of polyisobutylene sealant 526, 528 are positioned respectively between the spacer 516 and each of the sheets 10, 12. Two cordons of polysulphide or silicone resin 530*a*, 530*b* are positioned in contact with the sealant 526, 528 between each of the sheets 10, 12 and the spacer 516 but substantially not in this embodiment beyond the spacer 516. The arm portions 518, 520 of the spacer 516, which are in contact with the sealant 526, 528 each extends obliquely with respect to the inner surface 532, 534 of the adjacent sheets 10, 12, such that the layers of sealant 526, 528 in contact therewith extend progressively from a region 540 of minimum thickness of about 0.1 mm to a region 542 of maximum thickness of 1.75 mm. The angle formed by the arm portions 518, 520 of the spacer 516 with the sheets 10, 12 is about 19°. The depth of the sealant 526, 528 is 5 mm and the depth of the resin 530*a*, 530*b* is also 5 mm. The resin 530 is in contact with the sealant 526, 528 in the region 542 of maximum thickness.

In use, the sealant 526, 528 provides a barrier to the penetration of water vapour into the gas space 14 while the resin 530 serves to retain the sheets 10, 12 in their face-to-face relationship, by securing the sheet 10 to the arm 518 of the spacer 516 and securing the sheet 12 to the arm 520 thereof. Compared with the embodiment shown in FIG. 1, the embodiment of FIG. 5 uses less resin without sacrificing the resistance to penetration of water vapour and the securing of the sheets of glass. In this embodiment, when the sheets are subjected to a force tending to separate them, all of the resin which is subjected to a traction stress has a reduced thickness compared to the resin with extends beyond the spacer 16 in the embodiment of FIG. 1, and is therefor stretched to a lesser extent.

As a variation the maximum thickness of the sealant may be 1 mm and the angle formed by the arm portions 518, 520 of the spacer 516 with the sheets of glass 10, 12 may be about 12°.

Two glazing units according to the invention were tested in accordance with two testing regimes. The first regime corresponded to the European Standard CEN/TC 129/WG4/EC/N 1 E dated January 1993 in which recycling between −18° C. and 53° C. was for 56 cycles over 12 hours followed by a plateau at a relative humidity of 95% of 1176 hours. In the second regime being a modification of the first CEN regime, recycling between −18° C. and 53° C. was for 28 cycles over 12 hours and the plateau at a relative humidity of 95% was for 588 hours. The glazing units had glass sheets 10, 12 of 4 mm thickness with an air space 14 of 12 mm there-between. The units differed according to the nature, and in particular the modulus of elasticity, of the resin used, this modulus being measured in traction at 20° C. for 12.5% relative elongation. The configuration of the units was as shown in, and described in connection with, FIG. 5 except that a tablet of desiccant was included, as shown by reference 24 in FIG. 1.

The first unit used resin "DC 362" (a two component silicone sold by DOW CORNING) having a modulus of elasticity of 1.96 MPa (E=20 kg/cm$^2$). The permeability measured was 0.072 g water for the double glazing under the first regime, and 0.032 g under the modified regime. Under the same conditions, a conventional glazing unit gave a permeability of 0.3 g water for the double glazing under the modified regime. Where the Al/Zn alloy spacer was replaced by a galvanised steel spacer of 0.4 mm thickness, the permeability according to the first test regime was found to be 0.1 g water for the unit.

The second unit used resin "POLYREN 200" (a two component polyurethane sold be the European Chemical Industry ECI) having a modulus of elasticity of 4.41 MPa (E=45 kg/cm$^2$). The permeability measured was 0.024 g water for the double glazing under the first regime, and 0.013 g under the modified regime. Under the same conditions, a conventional glazing unit gave a permeability of 0.1 g water for the double glazing, under the modified regime. Where the Al/Zn alloy spacer was replaced by a galvanised steel spacer of 0.4 mm thickness, the permeability according to the first test regime was found to be 0.044 g water for the unit, and 0.07 g water after two complete cycles of this regime. Under the same conditions a conventional double-glazed unit with a galvanised steel spacer having a thickness of 0.5 mm exhibited a permeability of 0.3 g water after one complete cycle of the CEN regime and 1.2 g water after 2 complete cycles.

In a variation of the embodiment shown in FIG. 5, the spacer may be provided with a permanent cover which serves to retain a desiccant material in the hollow interior of the spacer. This cover may itself be flexible, for example by the incorporation of a longitudinal fold, to avoid substantially reducing the flexibility of the arm portions 518, 520.

In a further variation of the embodiment shown in FIG. 5, the extreme edges of the arm portions 518, 520 may be folded over upon themselves towards the exterior, over a depth of say 0.1 or 0.2 mm. This construction provides additional rigidity to the spacer frame to assist the handling thereof during the construction of the double glazing unit. These folded over edges occupy the zone where the thickness of the sealant 526, 528 is very low, so that substantially no resistance to the ingress of humidity is lost.

What is claimed is:

1. A multiple glazing unit comprising:

two vitreous material sheets positioned in a face-to-face spaced apart relationship and defining a gas space therebetween;

a spacer extending peripherally with respect to the two sheets, delimiting the gas space and having a top;

layers of sealant positioned between the spacer and each of the sheets such that the spacer does not contact the sheets, the layers of sealant forming a barrier to water vapor, the spacer further having spacer faces in contact with the layers of sealant; and at least one cordon of resin being positioned to be in contact with the layers of sealant and extending at least between the spacer and each of the sheets for retaining the sheets in their face to face relationship;

wherein:

at least part of each spacer face in contact with a corresponding one of the layers of sealant extends obliquely from the top of the spacer with respect to an inner surface of an adjacent sheet, the corresponding one of the layers of sealant extending progressively from a region of minimum thickness at the top of the spacer to a region of maximum thickness;

the cordon of resin is in contact with each of the layers of sealant substantially in the region of maximum thickness thereof; and the spacer has a cross section which is open to the gas space.

2. The multiple glazing unit according to claim 1, wherein:

a first part of each spacer face in contact with the corresponding one of the layers of sealant extends obliquely with respect to the inner surface of the adjacent sheet; and a second part of each spacer face in contact with the corresponding one of the layers of sealant extends substantially parallel with respect to the inner surface of the adjacent sheet thereby forming an extended region of maximum thickness for the corresponding one of the layers of sealant.

3. The multiple glazing unit according to claim 1, wherein the spacer has a cross-section having a hollow trapezium shape.

4. The multiple glazing unit according to claim 1, wherein the spacer has a cross-section having a flared "U" shape.

5. The multiple glazing unit according to claim 4, wherein the spacer comprises two flared arm portions and a base portion interconnecting the arm portions.

6. The multiple glazing unit according to claim 5, wherein the arm portions are interconnected by the base portion deformably.

7. The multiple glazing unit according to claim 1, further comprising a desiccant disposed within the spacer.

8. The multiple glazing unit according to claim 7, wherein each layer of sealant has a thickness in the region of minimum thickness which is not greater than 0.5 mm.

9. The multiple glazing unit according to claim 8, wherein each layer of sealant has a thickness in the region of minimum thickness which is not greater than 0.2 mm.

10. The multiple glazing unit according to claim 1, wherein the cordon of resin extends to a depth of at least 2.0 mm inwardly along a surface of the vitreous material sheets.

11. The multiple glazing unit according to claim 1, wherein the cordon of resin has a depth beyond the spacer between the sheets which is not greater than 0.2 mm.

12. The multiple glazing unit according to claim 11, wherein the cordon of resin has a depth beyond the spacer between the sheets which is not greater than 0.1 mm.

13. The multiple glazing unit according to claim 11, wherein at least part of each spacer face in contact with the corresponding one of the layers of sealant extends obliquely with respect to the inner surface of the adjacent sheet at an angle of at least 9.1°.

14. The multiple glazing unit according to claim 1, wherein the layers of sealant contain a desiccant.

* * * * *